United States Patent [19]

Akiyama et al.

[11] 4,014,538

[45] Mar. 29, 1977

[54] SHEET SEPARATING DEVICE IN ELECTROSTATIC RECORDING APPARATUS

[75] Inventors: Mitsuo Akiyama, Higashi-Murayama; Masamitsu Kasuya, Nagareyama, both of Japan

[73] Assignee: Konishiroku Photo Industry Co., Ltd., Tokyo, Japan

[22] Filed: Oct. 23, 1975

[21] Appl. No.: 625,045

[30] Foreign Application Priority Data

Oct. 28, 1974 Japan ..... 49-124588

[52] U.S. Cl. ..... 271/176; 271/189

[51] Int. Cl.[2] ..... B65H 43/00

[58] Field of Search ..... 271/174, 176, 189, DIG. 2, 271/80, 258, 64, 173

[56] References Cited

UNITED STATES PATENTS 3,687,539 8/1972 Furuichi ..... 355/8

3,923,298 12/1975 Ishida ..... 271/174

3,926,429 12/1975 Satomi ..... 271/174

*Primary Examiner*—Richard A. Schacher

*Attorney, Agent, or Firm*—Bierman & Bierman

[57] ABSTRACT

Apparatus for separating sheets from a belt driven photosensitive surface in which a pair of rollers are disposed on opposite sides of the photosensitive surface downstream of the transfer paper feed point. One of the rollers is movable from a position spaced from the photosensitive surface to a position in which it contacts the sheet carried by the photosensitive surface and cooperates with the other roller to separate the sheet from the photosensitive surface. A sensor is provided to detect the absence of a sheet and to prevent the movable roller from contacting the photosensitive surface in the absence of a transfer sheet.

2 Claims, 5 Drawing Figures

SHEET SEPARATING DEVICE IN ELECTROSTATIC RECORDING APPARATUS

This invention relates to a sheet separating device for use in an electrostatic recording apparatus such as an electrophotographic copying machine, and an electrostatic printing machine.

In connection with the electrostatic recording apparatus in which a toner image is transferred onto a plain paper, especially a copying machine of the type in which a toner image is formed on a surface of a band of a photosensitive material (electrostatic recording element), the toner image is transferred onto a sheet-type paper and then the sheet-type paper is separated from the photosensitive material after completion of the transfer operation. There have heretofore been proposed and practised various methods for separating paper sheets from the electrostatic recording medium, and in particular from the photosensitive material. For example, one method employs air jetted between a photosensitive material and a paper sheet electrostatically attracted thereto to thereby effect separation. Another method in which a paper sheet, electrostatically attracted to a photosensitive material, is sucked and separated from the photosensitive material by means of a sucking device has also been used.

We previously developed and proposed a new method in which a part of a band-type photosensitive material is deflected by a pair of rollers to thereby separate forcibly the forward end of a paper sheet from the photosensitive materials the paper sheet then being completely separated from the photosensitive material by means of a grounded roller. It was found that according to this new method, separation can be accomplished very efficiently.

However, when the photosensitive material is deflected by using a pair of the above-mentioned rollers, although good results can be obtained while paper sheets are always fed precisely to the toner image transfer zone, it sometimes happens that the feeding of paper sheet is interrupted. This can occur, for instance, when trouble develops in the paper sheet feed device or because the supply of paper sheets runs out. In such case, since a toner image has already been formed on the surface of the photosensitive material, the deflecting members, such as the above-mentioned pair of rollers, which are preferably rotatable will directly contact with the toner image formed on the surface of the photosensitive material. The toner will be picked up and adhere to the deflecting members. Accordingly, during the copying operation of the next cycle, the toner adhering on the deflecting members is transferred to and contaminates the back surface of the paper sheet.

An object of present invention is to overcome the above defect involved in our previous proposal.

More specifically, in accordance with the present invention, a switch member (or a photoelectric tube) is mounted at a part of a sheet feed mechanism and the switch member is actuated by one end of a paper sheet when it is supplied. By actuation of the switch member, the operation of deflecting the electrostatic recording member by the above-mentioned deflecting members is normally accomplished. On the other hand, when no paper sheet is supplied, the switch member is not actuated and hence, the deflecting operation by the deflecting members is not performed and the toner image formed on the electrostatic recording member is pevented from adhering to the rotary rollers or the like disposed as the deflecting members.

One embodiment of the present invention will now be described with respect to a sheet separating device for use in a copying machine by reference to the accompanying drawings wherein FIG. 1 is a front view showing the entire assembly of the copying machine;

Figure 1:
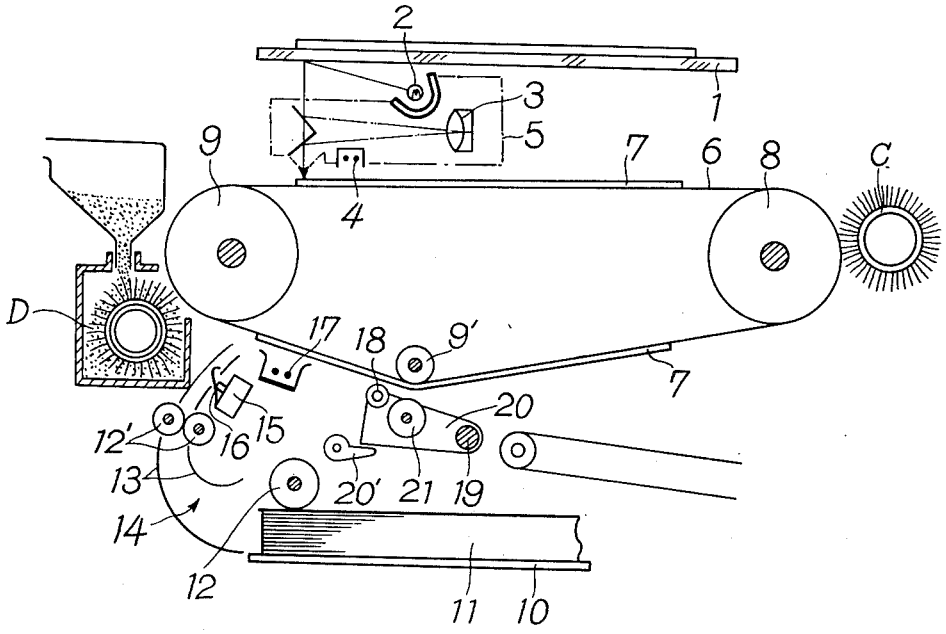

In a copying machine frame, there are provided a stational original support 1, a light source 2 disposed under the original support 1, and an electrically discharging and image-wise exposing unit 3 including mirrors and lens and a corona discharge device 4. A pair of sheet-type electrostatic recording members 7 are mounted on a pair of endless belts 6 which are in turn mounted on rotary supports 8 and 9. The belts 6 are tightened by a roller 9' disposed intermediately between the two rotary supports 8 and 9. Transfer sheets 11 are placed on a paper stand 10 and they are fed one by one by means of a paper feed roller 12 placed on the top sheet. A detailed mechanism for one-by-one feeding is known in the art and hence the explanation of the mechanism is omitted. Paper guide plates 13 are disposed to form a paper passage and a detecting lever 16 of a switch 15 for detecting the transfer sheet 11 projects into the passage 14. 12' indicates a pair of paper feed rollers. Reference numeral 17 denotes a corona discharging device for toner image-transferring. A separating roller 18 is rotatably mounted on a frame 20, one end of which is pivoted on a machine frame 19. A grounded roller 21 is disposed to electrostatically attract the sheet 11. The separating roller 18 is so arranged that it forms with the spreading roller 9' a pair of paper-separating rollers. When the separating roller 18 is brought close to the spreading roller 9', the sheet-type electrostatic recording member 7 is deflected or bent with a very small radius and the transfer sheet 11 is separated from the electrostatic recording member 7 because the sheet has a tendency to hold its straight form. An arm 20' is disposed to move the frame 20 in the veritcal direction. Symbols D and C denote a developing device and a cleaning brush, respectively.

Figure 2:
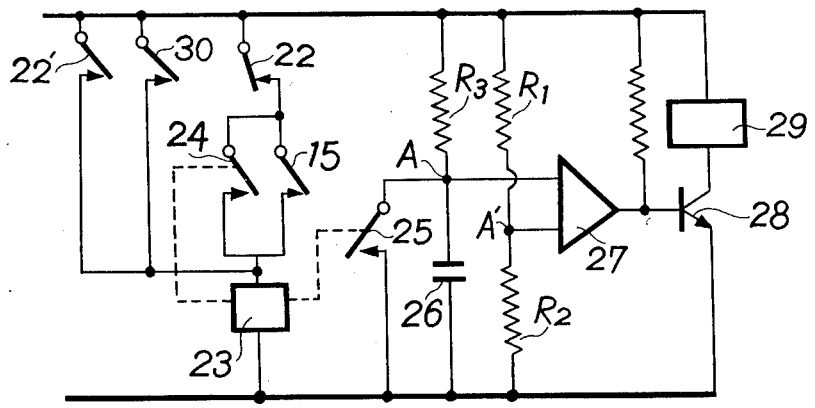
FIG. 2 is a block diagram showing a circuit for controlling the operation of the separating roller.

An electric circuit shown in FIG. 2 will now be described.

This circuit is so designed as to detect the feeding of transfer sheets 11. When the main switch (not shown) of the copying machine is closed, a switch 22 is simultaneously closed and a switch 22' is also closed for a short time to actuate a relay 23. The normally closed switch 15 for detecting the copying sheet 11, which is shown in FIG. 1, is connected through the switch 22. A switch 24 actuated by the relay 23 to retain the relay 23 in an energized condition is connected in parallel to the switch 15. A switch 25 actuated by the relay 23 is arranged in parallel with a condenser 26, and a comparator 27 is connected to the side of one condenser 26, whereby the charging voltage of the condenser 26 is detected and measured in the case of normal feeding of copying sheets by adjusting a resistance $R_3$ so that the potential at point A does not exceed a standard level A' given by resistances $R_1$ and $R_2$ in the circuit. The base of transistor 28 is connected to the comparator 27, and a solenoid 29 which is actuatable when a voltage is supplied to the base of the transistor is connected to the collector of the transistor 28. An emitter of the transistor 28 is connected to the other connecting terminal. A switch 30 is a restoration switch for the relay 23 to be used when mis-delivery of a copying sheet occurs.

Figure 5:
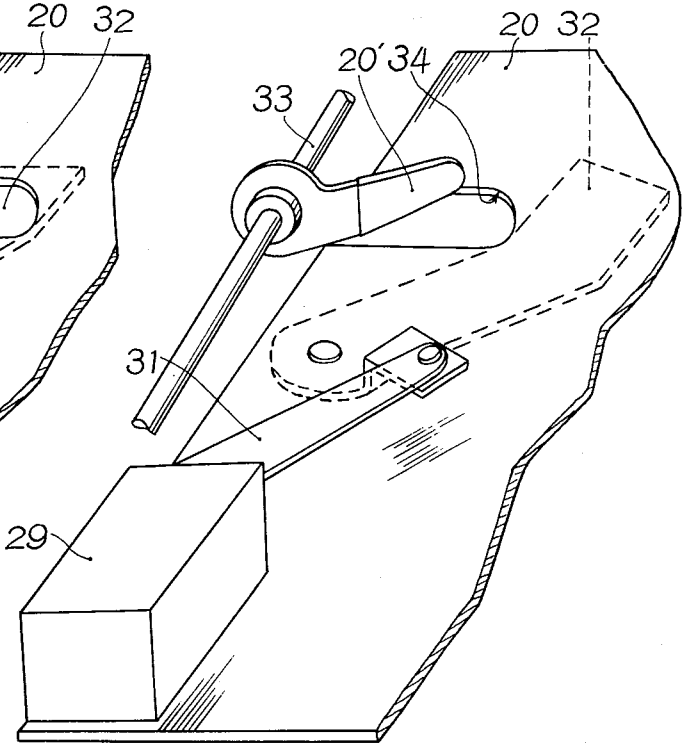
FIG. 5 is a perspective view of the operation element and regulating plate which are in a state in which the separating roller has not been actuated.

The present invention will now be described by reference to FIGS. 4 and 5.

Figure 4:
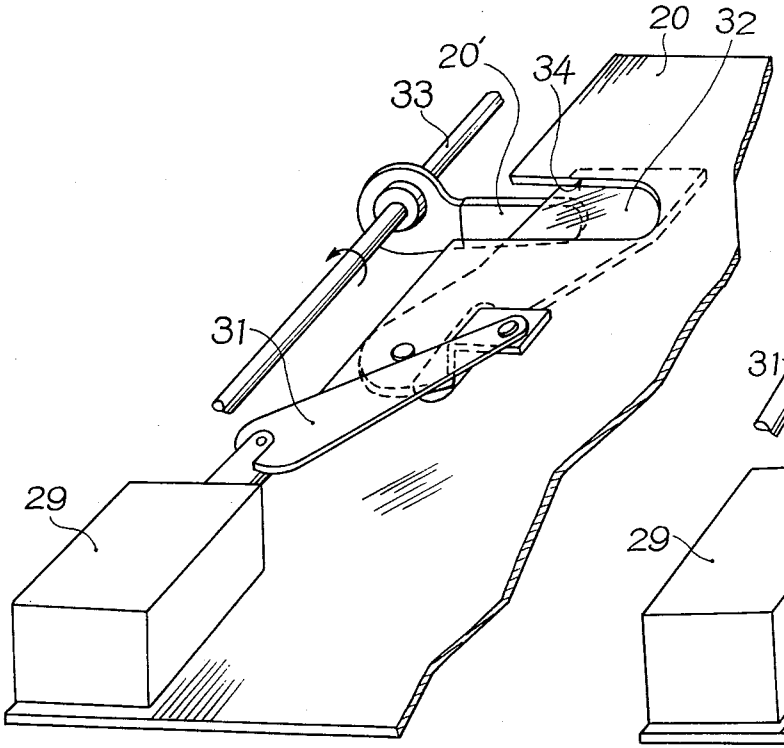
FIG. 4 is a perspective view of the operation element and regulating plate which are in a state in which the separating roller has been operated.

FIG. 4 shows the state of normal operation of separating the transfer sheet 11. The solenoid 29 is fixed to a part of the frame 20 so that a regulating plate 32 is rotated through a connecting lever 31 by the solenoid 29. The operation arm 20' is fixed to a rotatable shaft 33 which is rotated angularly in synchronism with the endless belt 6 so that the arm 20' is pivoted, and the top end of the operation arm 20' is disposed at the lower end of a notch 34 formed on the frame 20. When the regulating plate 32 is not actuated, it covers the notch 34. When the regulating plate 32 is actuated, it is removed from above the notch 34, as shown in FIG. 5.

The operation of the present embodiment having the above structure will now be described.

Figure 3:
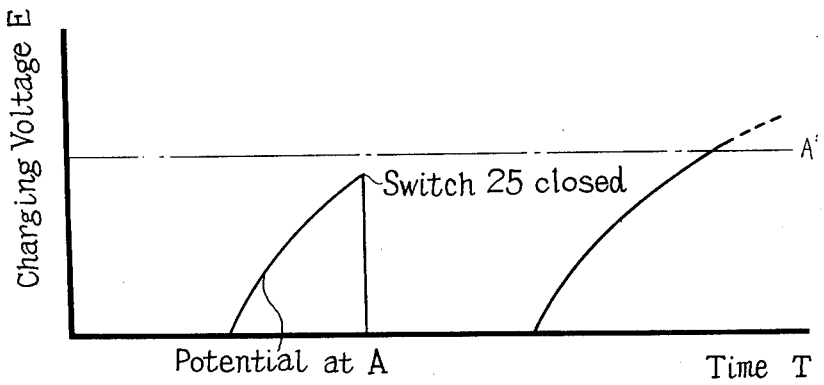
FIG. 3 is a diagram showing the relation between the charging voltage of the condenser and the switch in the control circuit shown in FIG. 2.

At normal copying operation, an original to be copied is placed on the original support 1 and is exposed to light from the light source 2. Reflecting rays are gathered on the electrostatic recording member 7 through the optical system 3. Prior to this light exposure, the electrostatic recording member 7 has been charged by the corona discharge device 4, and by this light exposure, charges are erased at areas exposed to light. Then, the electrostatic recording member 7 is subjected to the development treatment by the developing device D. This electrostatic recording method is generally adopted in the art. After completion of the devlopment treatment, the electrostatic recording member 7 is delivered to an image transfer zone. The paper feed roller 12 is actuated synchronously with the movement of the electrostatic recording member 7 or with the operation of the developing device D, and the transfer sheet 11 is fed into the guide passage 14. Then, the feed roller 12' is rotated and while the transfer sheet 11 is passing through the passage 14, the switch 22 is temporarily opened and then closed. The time after which temporary opening of the switch 22 occurs can optionally be set. This temporary opening of the switch 22 causes the relay to be made inoperable and then the switch 25 to be opened, so that the condenser 26 starts charging. The transfer sheet 11 is further advanced along the passage 14 and a part of the transfer paper 11 contacts the detection lever 16 of the switch 15 to actuate the lever 16 to close the switch 15. At this point, the relay 23 is energized to close the retention switch 24 for the relay 23 and the switch 25. In the embodiment shown in FIG. 2, since the switch 25 has been kept open from the start of the copying operation, the condenser 26 is charged in succession during this period. When the switch 25 is closed in the above-mentioned manner, a short circuit is formed, and therefore, before the potential of the + side of the condenser 26, namely the point A, reaches the standard lever A', it is lowered to the zero point (see the curve on the left side of FIG. 3). Accordingly, an electric current is prohibited from running to the base of the transistor 28 from the comparator 27 in which the standard potential A' is set, and the collector and emitter of the transistor 28 are kept in the electrically non-conducting state. Therefore, the solenoid 29 is not energized. In this state, the regulating plate 32 is allowed to cover the notch 34 as shown in FIG. 4, and the transfer sheet 11 falls in contact with the electrostatic recording member 7 and a powder image is transferred onto the transfer sheet 11 by the transfer electrode 17. The rotation shaft 33 is turned in the counterclockwise direction through a suitable moving mechanism, and the frame 20 is lifted up via the regulating plate 32 by the operation element 20'. Accordingly, the separating roller 18 presses the surface of the electrostatic recording member 7 through the transfer sheet 11 and the separating roller 18 deflects the surface of the electrostatic recording member 7 together with the spreading roller 9'. As a result, the transfer sheet 11 is separated from the electrostatic recording member 7, attracted by the grounded roller 21 and discharged from the copying machine. When the transfer sheet 11 is discharged, the switch 15 is opened to de-energize the relay 23 and open the switches 24 and 25.

The case where the copying machine is started although the transfer sheet 11 is not noramlly fed by the paper feed roller 12 or no transfer sheet 11 is present will now be illustrated.

The electrostatic recording member 7 is conveyed to the transfer zone after passage of the above-mentioned prescribed copying steps. Since no transfer sheet 11 is introduced into the guide passage 14, the detecting lever 16 of the switch 15 is not actuated. Accordingly, the switch 15 is kept open and the relay 23 is not actuated. Hence, the switches 24 and 25 are not closed. Accordingly, charging of the condenser 26, which has been started from initiation of the copying sheet delivery operation, is continued and the potential at the point A exceeds the standard value A' and increases sharply as indicated by a dotted line in a curve given on the right side of FIG. 3. Therefore, the comparator 27 is actuated to generate a voltage at the base of the transistor 28 and to connect electrically the collector and emitter of the transistor 28. Thus, the solenoid 29 is energized to actuate the regulating plate 32 through the connecting lever 31, whereby the regulating plate 32 is separated from the notch 34 as shown in FIG. 5. In this state, even if the operation element 20' is lifted up by the moving mechanism at a point when the electrostatic recording member 7 has passed the transfer electrode 17, the element 20' is only intruded into the notch 34 and the frame 20 is not lifted up. Accordingly, the separating roller 18 and grounded roller 21 are not lifted up and the separating roller 18 does not exert a pressing action to the toner image surface of the electrostatic recording member 7. In this case, the non-transferred toner is cleaned away by the cleaning brush C. In the case of mis-delivery of copying sheets, since the relay 23 is kept restored, it is necessary to close the switch 30 to actuate the relay 23. In the foregoing embodiment, the same effects can similarly be obtained even if the operation element 20' is arranged so that it is stopped when no transfer sheet 11 is fed.

As is seen from the foregoing illustration, according to the present invention, while the copying machine operates normally, the tightening roller 9' and separating roller 18 deflect the electrostatic recording member 7 and the transfer sheet 11 to forcibly separate the transfer sheet 11 from the electrostatic recording member 7. When no transfer sheet 11 is fed to the transfer zone because of trouble in the paper feeding operation or the absence of a supply of copying sheets, the operation of the separating roller 18 is automatically stopped and is prevented from contacting the electrostatic recording member 7. Therefore, even if no transfer sheet 11 is fed to the transfer zone, the separating roller 18 is not contaminated with the toner, and copies free of stain or contamination can always be obtained.

What we claim is:

1. A sheet separating apparatus for use in an electrophotographic recording system of the type having a belt, means for driving the belt and a photosensitive surface carried by said belt, and means for feeding a transfer sheet into contact with said photosensitive surface, the improvement comprising:

a. a pair of rollers arranged on each side of said belt downstream of the transfer sheet feeding means, one of said rollers being movable from a first position spaced from the belt to a second position in contact with said transfer sheet, the movable roll when in contact with said sheet cooperating with the other said roll to separate said sheet from the photosensitive surface;

b. means for detecting the presence and absence of transfer sheet feed to said photosensitive surface, and c. means for moving the said movable roll from said first position to said second position when the detecting means detect the presence of sheet feed.

2. The sheet separating apparatus according to claim 1 further comprising control means for operating the displacing means, said control means having a timer, means for allowing the timer to operate during sheet feed and beginning at a standard point in time prior to the time at which the detection means normally detects a sheet, said detection means rendering said timer inoperative upon detection of a sheet and permitting said timer to continue to operate in the absence of a detected sheet, said displacing means being adapted to operate to move the movable roller into contact with said transfer sheet a selected time subsequent to said standard point and after said timer has been rendered inoperative, said displacing means remaining inoperative during operation of said timer.

* * * * *